US006462766B1

(12) United States Patent
Roeber et al.

(10) Patent No.: US 6,462,766 B1
(45) Date of Patent: Oct. 8, 2002

(54) THERMAL RECORDER FOR USE WITH BATTERY-POWERED EQUIPMENT

(75) Inventors: Russell R. Roeber, Cedarburg; James M. Gray, Fox Point, both of WI (US)

(73) Assignee: GE Medical Systems Information Technologies, Inc., Milwaukee, WI (US)

( * ) Notice: Subject to any disclaimer, the term of this patent is extended or adjusted under 35 U.S.C. 154(b) by 0 days.

(21) Appl. No.: 09/434,089

(22) Filed: Nov. 5, 1999

(51) Int. Cl.[7] ..... B41J 2/37
(52) U.S. Cl. ..... 347/190
(58) Field of Search ..... 347/190 T, 191; 358/1.13; 235/462.45

(56) References Cited

U.S. PATENT DOCUMENTS

| | | | | |
|---|---|---|---|---|
| 4,407,003 A | | 9/1983 | Fukui | 346/76 PH |
| 4,510,505 A | | 4/1985 | Fukui | 346/76 PH |
| 5,375,604 A | | 12/1994 | Kelley et al. | 128/671 |
| 5,669,720 A | | 9/1997 | Negishi et al. | 400/120.05 |
| 5,895,906 A | * | 4/1999 | Danielson et al. | 235/462.45 |
| 6,108,097 A | * | 8/2000 | Suzuki et al. | 358/1.13 |
| 6,249,299 B1 | * | 6/2001 | Tainer | 347/197 |

FOREIGN PATENT DOCUMENTS

EP 0714781 A2 6/1996

OTHER PUBLICATIONS

Patent Abstracts of Japan , vol. 011, No. 225 (M–609), Jul. 22, 1987 & JP 62 041057 A (Seikosha Co. Ltd.), Feb. 23, 1987.

* cited by examiner

*Primary Examiner*—Michael Nghiem
*Assistant Examiner*—K. Feggins
(74) *Attorney, Agent, or Firm*—Ostrager Chong & Flaherty LLP

(57) ABSTRACT

A method and an apparatus for limiting the peak power consumed by a thermal recorder connected to portable battery-powered equipment. The battery-powered equipment is designed with a filter and an electronic circuit breaker. A circuit breaker current sense resistor and an output capacitor form an RC filter and provide a large current reservoir for the thermal recorder which averages the peak current demands seen at the circuit input. The electronic circuit breaker provides a current limit function and will not allow a current greater than a predetermined amperage level to be drawn. The thermal recorder has a CPU which provides pulses to a thermal print head in dependence on data incorporated in a pulse-width limit table. The values in the pulse-width limit table can be substituted for calculated pulse widths that would produce peak currents large enough to trip the circuit breaker.

20 Claims, 6 Drawing Sheets

LINEAR REGULATOR
Vout
Vin
ENABLE
92
LATCH
STROBE 1
STROBE 2
98
SPI BUS
96
ADC
104
TPU
TPU
QSPI
100
CPU
94
I/O
I/O
ASYNC 2
RX
ASYNC 1
TX
CHIP SELECTS
74
68
70
LATCHED XCVR
72
FLASH
76
SRAM
78
80
HOST WRITE
16 BIT HOST BUS
66
HOST READ
HOST ASYNC SERIAL BUS
HOST CONNECTOR
64

THERMAL RECORDER FOR USE WITH BATTERY-POWERED EQUIPMENT

FIELD OF THE INVENTION

This invention generally relates to portable battery-powered equipment having a thermal recorder. In particular, the invention relates to such battery-powered equipment used to monitor patients during transport in a hospital or other patient care setting.

BACKGROUND OF THE INVENTION

When providing medical care to patients, it is frequently necessary to monitor the patient using medical diagnostic instruments. One type of instrument, the patient monitor, is capable of monitoring the patient to acquire electrocardiogram data, cardiac output data, respiration data, pulse oximetry data, blood pressure data, temperature data and other parameter data. In particular, lightweight portable monitors exist which can be moved with the patient, allowing continuous monitoring during patient transport.

To facilitate monitoring at remote locations or during patient transport, modern portable patient monitors are powered by rechargeable batteries. Extended-use batteries, with quick recharge times, help maximize monitor availability. Advanced monitors have a smart battery management system which maximizes battery life, reducing maintenance and replacement. These patient monitors can also be plugged into any conventional electrical power system for use, e.g., at the patient's bedside, before and/or after the patient is transported. At the bedside, advanced patient monitors can be hard-wired to a central station via a local area network (LAN) for enhanced patient surveillance efficiency. In addition, the most advanced patient monitors have a built-in wireless option which enables the monitor to go mobile without sacrificing connectivity. Such monitors also support importation of demographic and laboratory data from a hospital information system for increased efficiency.

Portable patient monitors with integral battery power supply are commercially available in a compact, ergonomic package which allows easy handling. Typically such monitors have a drop-tested rugged design which allows them to withstand the punishment of the demanding intra-hospital transport applications. Mounting options make these monitors ideally suited for headboard/foot-board, siderail, rollstand and IV pole use. The compact design is achieved in part through the use of flat display panels. The color or monochrome screen accommodates all numerics and multiple waveforms.

In addition to displaying waveforms and numerics representing the data being acquired, advanced patient monitors have a central processing system which stores and analyzes the acquired data. In particular, the central processing system is programmed with algorithms for analyzing the acquired data. The central processing system controls the transfer of data to the display panel for display and to the LAN via either a hardwired or wireless connection. In addition, the central processing system sends the data to a thermal recorder, which prints the data on a substrate.

Thermal recorders used in power-limited environments, such as portable battery-powered equipment, need to have a reliable means of limiting peak power demands. Typically the thermal recorder consumes a disproportionately large share of the system power. This power consumption can reach extreme levels, especially during electrocardiograph (ECG) artifacts such as lead failure (e.g., a lead falling off the patient's chest) and when an electrosurgical unit (ESU) is being used, which produce spikes in the power consumed by the thermal recorder. The high peak power demands imposed by thermal recorders require host designers to give special consideration to the power supply. The host power supply must have a large enough capacity to deliver the required peak power, resulting in a larger, more complicated and costly power supply. These considerations present unique design problems, especially for portable equipment whose typical prerequisites are small size and low weight.

SUMMARY OF THE INVENTION

The present invention is a method and an apparatus for limiting the peak power consumed by a thermal recorder connected to portable battery-powered equipment. In accordance with the preferred embodiment, the solution to the problem of limiting the peak power involves a hardware solution contained in the battery-powered equipment combined with a software solution contained in the thermal recorder.

The hardware solution uses a filter and an electronic circuit breaker. A circuit breaker current sense resistor and an output capacitor form an RC filter and provide a large current reservoir for the thermal recorder which averages the peak current demands seen at the circuit input. The electronic circuit breaker provides a current limit function and will not allow a current greater than a predetermined amperage level to be drawn. This forces peak demands above the predetermined amperage level from the thermal recorder to be drawn from the output reservoir capacitor. If these peak demands are continuous for a set period of time, the electronic circuit breaker will trip and will remove power from the thermal recorder.

The software contained in the thermal recorder uses a pulse-width limit table. The thermal recorder operates on the principle of producing an image by burning dots onto the surface of specially coated paper that is drawn across a print head. The burning of the dots by miniature heating elements in the print head is what consumes the large amount of current. The amplitude of the current depends on the number of dots burned. The darkness of the image is controlled by the length of time the heating elements are turned on. The length of time must be varied by the thermal recorder software to maintain consistent image darkness due to external factors such as a changing supply voltage. In accordance with the preferred embodiment of the invention, the length of time the heating elements are turned on is restricted per burn cycle in order to limit peak current demands.

The invention also encompasses a method of programming a thermal recorder to limit the peak power consumed. In accordance with this method, the length of time or pulse-width limits to be applied by the thermal recorder are empirically derived from the hardware. The steps of the method are as follows. First, an electronic load is connected to the hardware. A periodic load is applied equal to the frequency of the burn cycle used by the thermal recorder. The duty cycle of the load is set to a multiplicity of different values and for each selected value, the load is slowly increased until the electronic circuit breaker is tripped and the corresponding value of the maximum current is recorded. The maximum currents along with the respective duty cycle values are then graphed and the equation which fits the graphed data is determined. This equation is then used to construct a pulse-width limit lookup table, which is stored in memory inside the thermal recorder. Incorporating multiple pulse-width limit tables can make for further enhancements to account for various host supply voltages and current limits.

When the thermal recorder calculates that required pulse width used to burn dots, it will take this value and compare it to a value pulled from the pulse-width limit table and use the lesser of the two. If the pulse width from the limit table is used, this will have the effect of lightening the dots used in this burn cycle. The dots will be lightened only to an extent required to not trip the electronic circuit breaker. Sections of the produced image that have been pulse-width limited will typically be confined to artifacts caused by ECG lead failure or ESU interference.

DETAILED DESCRIPTION OF THE PREFERRED EMBODIMENTS

Figure 1:
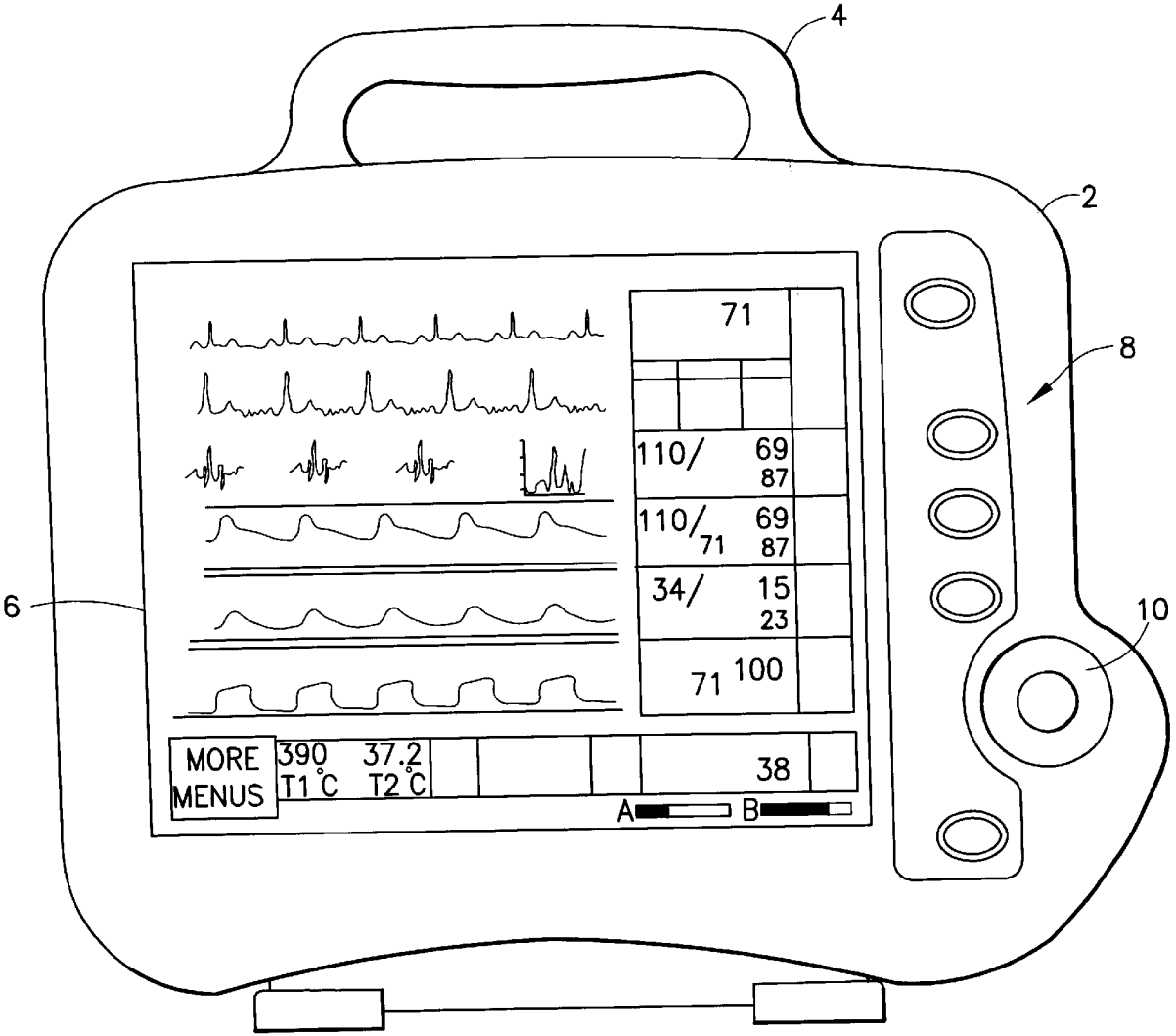
FIG. 1 is a schematic showing a generally frontal view of one commercially available portable patient monitor.

A known portable patient monitor, depicted in FIG. 1, comprises a. housing 2 and a handle 4 connected to the top of the housing. A flat display panel 6 is secured in a generally rectangular window formed in the front face of the housing 2. An operator interface comprising a plurality of keys, forming a keypad 8, and a so-called "trim" knob 10, which allows the user to select and focus on a particular menu. The display panel 6 displays waveforms and numerical data. The status of a pair of batteries A and B is indicated in the lower right-hand corner of the display panel.

The portable battery-powered patient monitor shown in FIG. 1 is typically connected to a thermal recorder, which is used to record acquired data. Although the present invention is directed to the thermal recorder and the means for providing electrical power from the batteries to the thermal recorder, a general description of the internal structure of the patient monitor will be provided for the sake of completeness.

The patient monitor depicted in FIG. 2 comprises a processor/power management subassembly 16, a display subassembly 18 and a data acquisition system module 20, each of which will be described below.

The processor/power management subassembly 16 comprises a processor board 22 powered by an ac mains power supply via a power supply board 24. Alternatively, the processor board 22 can be powered by rechargeable batteries 26 when the patient monitor is disconnected from the mains power supply, e.g., during patient transport. The processor/power management subassembly 16 further comprises a peripheral expansion connector 28, which allows the processor to communicate with peripheral processors added as the result of future expansion of the system.

The display subassembly 18 comprises a liquid-crystal display (LCD) flat panel 6, a backlight inverter 30 for powering the fluorescent tubes of the flat display panel and a keypad 8 for operator inputs. The flat display panel 6, the backlight inverter 30 and the keypad 8 are electrically coupled to the processor board 22 via a display flexible printed circuit board (flex) 32.

The data acquisition system (DAS) module 20 comprises a plurality of ports for patient connections and a DAS board 34. The patient connection for acquiring noninvasive blood pressure (NBP) data is coupled to the DAS board 34 via an NBP flex 36. The leads for acquiring electrocardiogram (ECG), respiratory and other cardiovascular data are coupled to the DAS board 34 via a patient connector flex 38. The ECG leads connect to electrodes attached to the patient's chest. The acquired data is sent to the processor board 22 for signal processing and analysis via the display flex 32. The processor board 22 controls the display panel 6 to display the desired waveforms and numerical data based on the acquired data received from the DAS board 34.

Figure 2:
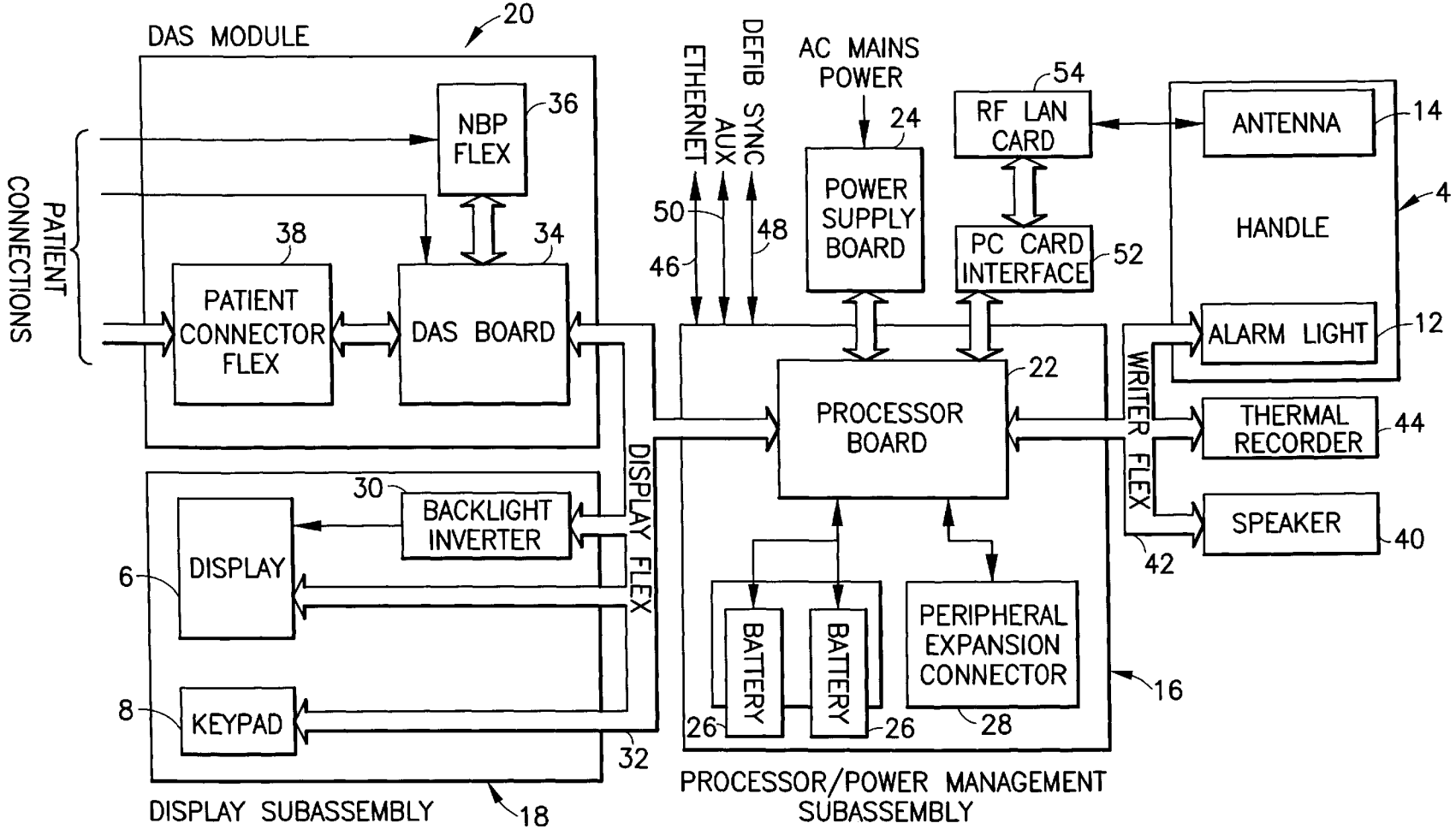
FIG. 2 is a block diagram showing a patient monitor with a thermal recorder connected thereto.

In addition to displaying acquired data, the patient monitor depicted in FIG. 2 also has the capability of automatically activating audible and visual alarms in response to acquired data exceeding a preset alarm threshold. The alarm thresholds are user-selectable via keypad entries. The visual alarm indicator is an alarm light 12 which flashes when activated; the audible indicator is an audio speaker 40 which emits alarm tones when activated. The alarm light 12 and audio speaker 40 are controlled by the processor board 22 via a writer flex 42. The processor board 22 also controls a thermal recorder 44 via the writer flex 42. The thermal recorder 44 serves to create a written record of selected data readings.

The patient monitor shown in FIG. 2 also has the ability to communicate with a LAN (not shown) via a hard-wired Ethernet connection 46, with a defibrillator (not shown) via connection 48 and with an auxiliary piece of equipment (not shown), e.g., a ventilator or a remote control device, via connection 50. The processor board provides synchronization signals to the defibrillator via connection 48. Also the patient monitor can communicate wirelessly with the LAN using an antenna 14. The processor board 22 sends signals to and receives signals from the antenna 14 via a PC card interface 52 which interfaces with a RF LAN card 54. The PC card interface 52 plugs into a socket which resides on the processor board 22.

Figure 3:
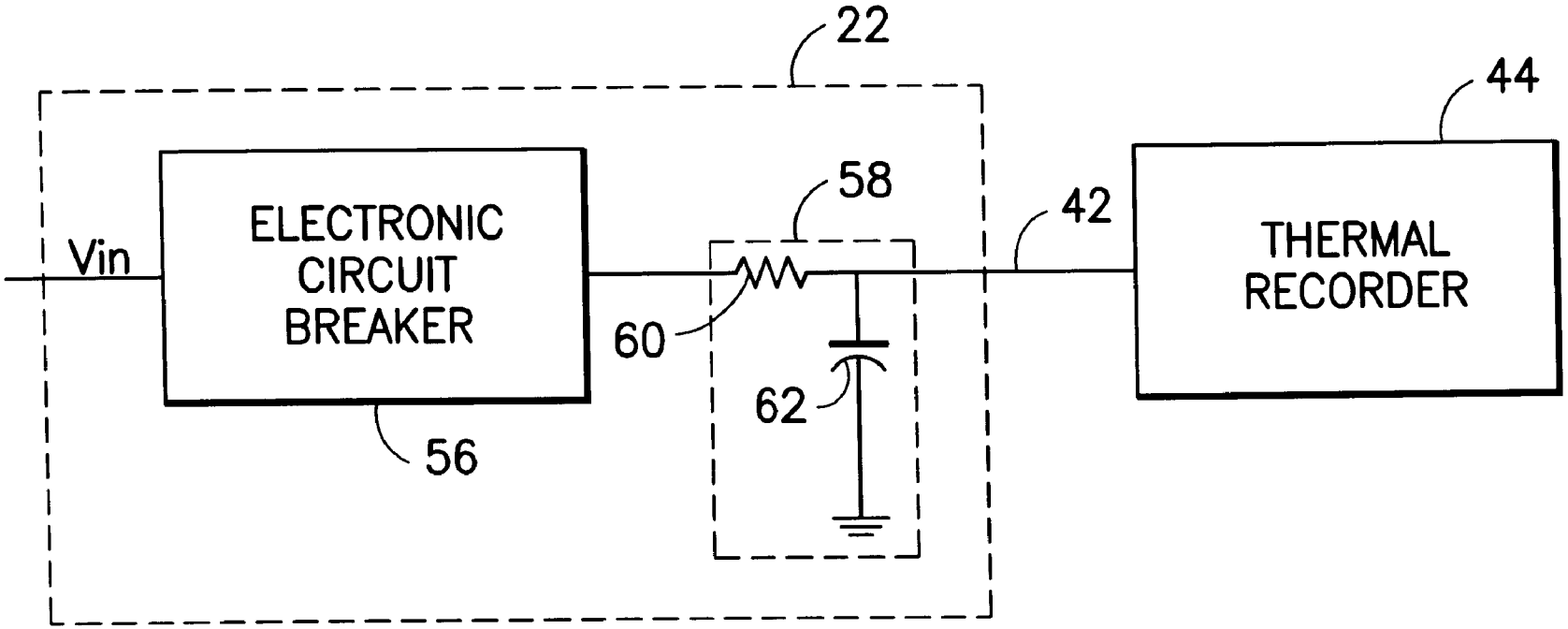
FIG. 3 is a block diagram showing hardware incorporated inside the patient monitor for use with a thermal recorder in accordance with the preferred embodiment of the invention.

The preferred embodiment of the present invention comprises hardware incorporated on the processor board 22 and software incorporated in the thermal recorder 44. Referring to FIG. 3, the processor board comprises a current sense resistor 60 and an output capacitor 62 which form an RC filter 58 and provide a large current reservoir for the thermal recorder 44 which averages the peak current demands seen at the circuit input $V_{in}$. An electronic circuit breaker 56 (preferably an integrated circuit having a timer built in) provides a current limit function and will not allow a current greater than a predetermined amperage level (e.g., 2.5 amps) to be drawn. This forces peak demands above the predetermined amperage level from the thermal recorder 44 to be drawn from the output reservoir capacitor 62. If these peak demands are continuous for a set period of time, the electronic circuit breaker 56 will trip and will remove power from the thermal recorder 44.

Figures 4, 4A, 4B:
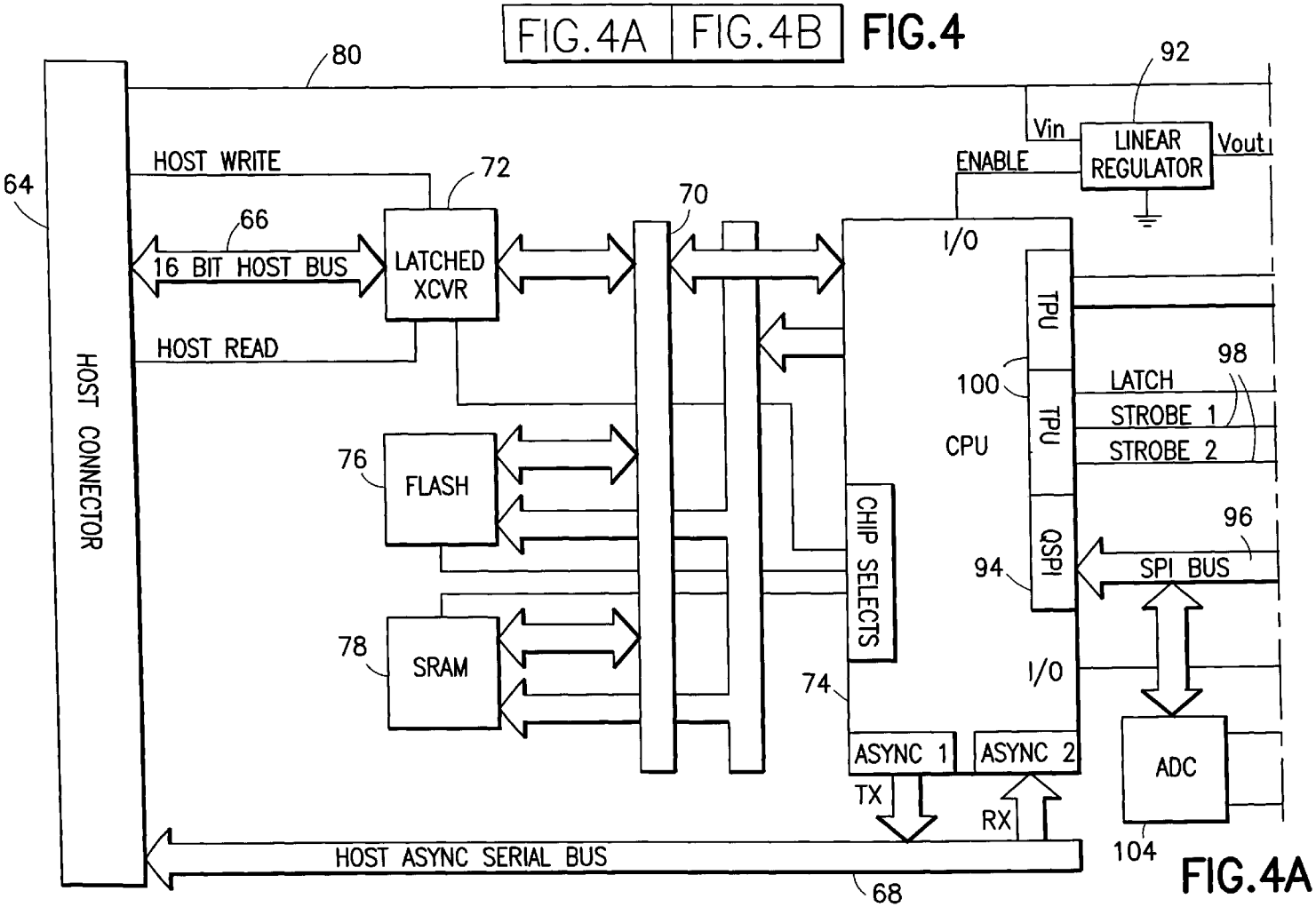
FIG. 4 is a circuit diagram showing portions of a circuit board incorporated in a thermal recorder in accordance with the preferred embodiment of the invention.
Figure 4B:
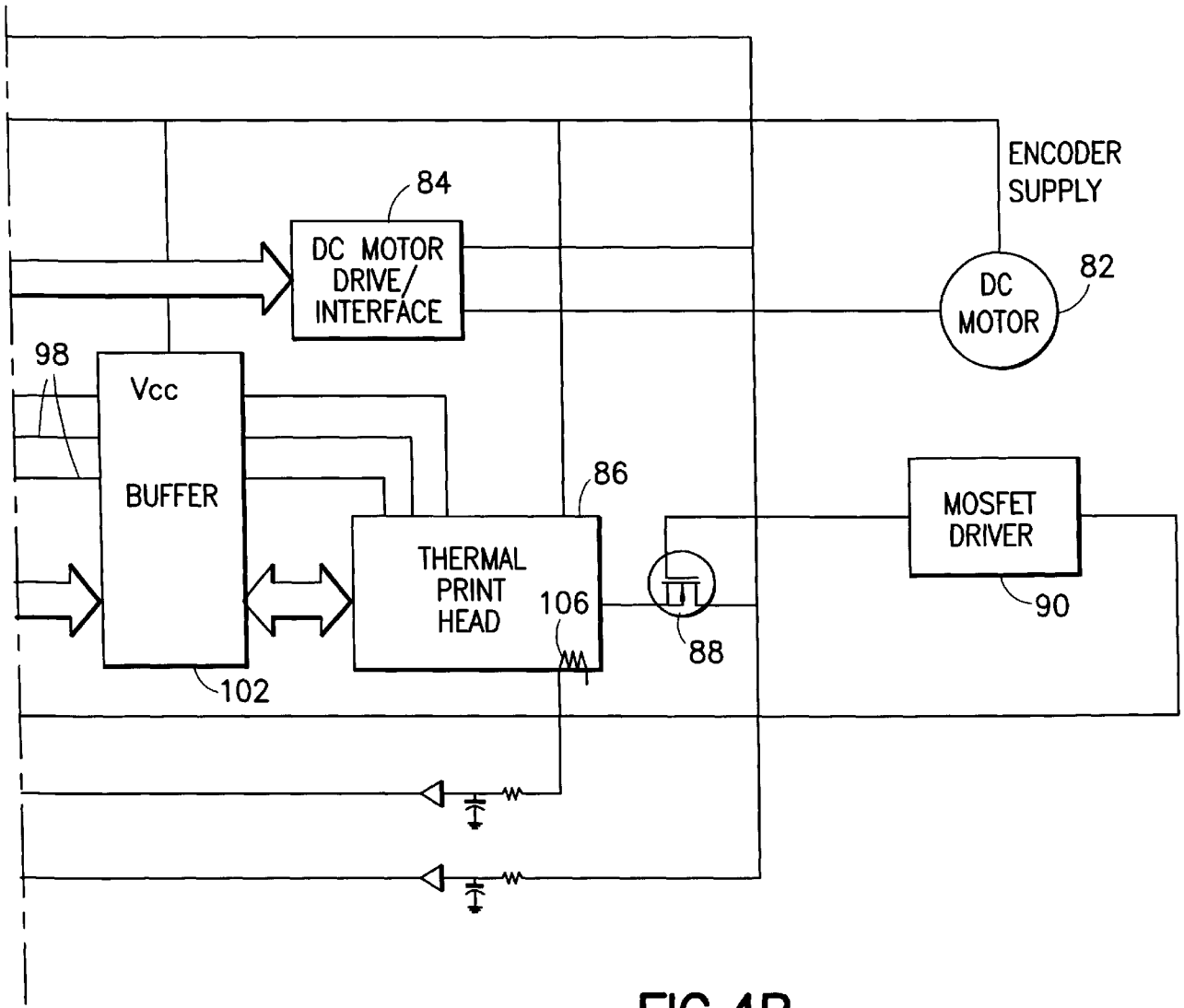

In accordance with the preferred embodiment, the aforementioned software is incorporated in a thermal recorder of the type shown in FIG. 4. However, it will be appreciated that the invention has application in any thermal recorder having a print head controlled by a central processing unit.

The thermal recorder shown in FIG. 4 is a self-contained print engine. The host device, i.e., the patient monitor, provides power and interface signals via a host connector 64. The thermal recorder has both a parallel interface 66 and a serial interface 68. The host device uses one or the other. The parallel interface 66 is coupled to a data bus 70 via an 8-bit bi-directional latched transceiver 72.

The data bus 70 in turn is connected to data inputs of a central processing unit 74. The CPU 74 is a microprocessor capable of performing all the necessary processing to acquire the host data (serial or parallel), process the data, and present the data in hard copy format. The CPU PCB has adequate memory resources for code storage/execution, in-system programmability, buffering of host data, and storage of system variables. The memory comprises boot/main code memory 76 and volatile random access memory (RAM) 78. In the preferred embodiment, memory 76 is a flash PROM and memory 78 is an SRAM. The boot code and the main code are both stored in flash PROM 76, the boot code being stored in a first sector and the main code being stored in the remainder of the flash PROM. SRAM 78 is the main "Scratch Pad" memory and is used to store incoming data from the host and system variables.

In addition, the CPU 74 has a time processing unit (TPU) 100 for providing pulses to the print head elements and for providing pulses to the DC motor 82, which moves the paper being recorded on.

The thermal recorder is preferably supplied with two DC voltages: +3.3 V ±5% @100 mA (max) and +8.5 to +18.0 V @15 W (max). The +3.3 V supply is used to power all the digital control circuitry on the thermal recorder CPU printed circuit board (PCB). The thermal recorder has a software-enabled low-power mode. In the low-power mode the thermal recorder will draw less than 10 mA. As seen in FIG. 4, the +8.5 to +18.0 V supply on line 80 is used to power the DC motor 82 via the DC motor drive/interface 84 and to power the thermal print head 86. The 15-W limit for the +8.5 to +18.0 V supply is controlled with software. The voltage supply to the thermal print head 86 can be switched off, when the thermal print head is not in use, using a high-side N-channel MOSFET 88 with a MOSFET driver 90 controlled by a single output from the CPU 74.

The thermal print head 86 requires a synchronous interface for loading data and two timer-controlled burn strobes (pulses) for respective groups of printer elements. A synchronous peripheral interface 94 incorporated in the CPU 74 and an SPI bus 96 provide the synchronous interface. Specifically, the SPI bus 96 loads M bits of control data into the print head for controlling which of the M heating elements of the print head will be turned on (energized) when the burn strobes are fired. The burn strobes (pulses) are provided on lines 98 by TPU 100 in the CPU 74. The thermal print head requires 5 $V_{DC}$. A 3.3 $V_{DC}$ to 5 $V_{DC}$ buffer 102 is used to translate the 3.3 $V_{DC}$ signals from the CPU 74 to 5 $V_{DC}$ levels acceptable to the print head 86. A linear regulator 92 generates the 5 $V_{DC}$ from the 8.5–18.5 $V_{DC}$ supply. The 5 $V_{DC}$ will power the thermal print head 86 and the buffer 102. The linear regulator 92 is enabled by the CPU 74.

An 8-bit analog-to-digital (ADC) 104 converts the analog voltage value of a thermistor 106 embedded in the thermal print head 86 and the thermal print head voltage 80 to digital values. These 8-bit values are used by the CPU 74 to set the burn strobe (pulse) width and to sense over-temperature for the thermal print head.

In accordance with the preferred embodiment of the invention, the CPU 74 controls the pulse width of each burn strobe so as not to exceed the pulse-width limits stored as software, e.g., a lookup table, in flash memory. The width of the pulse determines the time interval during which current is supplied to miniature heating elements (not shown) in the print head 86. The amplitude of the current consumed depends on the number of dots burned, miniature heating element resistance and print head voltage. The darkness of the image is controlled by the length of time the heating elements are turned on. The length of time (i.e., pulse width) is varied by the CPU in accordance with a conventional constant-joule (energy) algorithm, thereby maintaining consistent image darkness due to external factors such as a changing supply voltage. For example, if the voltage supply decreases, the pulse width is increased. In addition, the CPU 74 uses the current voltage data received from the ADC 104 to calculate the pulse width (i.e., TPU value) necessary to achieve a desired current input. The CPU also uses the current temperature data received from the ADC 104 to adjust the calculated TPU value in dependence on the temperature of the print head elements. In particular, the TPU value is reduced as the element temperature increases. The CPU then extracts a maximum pulse width (TPU value) from the maximum pulse width lookup table based on the number of dots turned on, the resistance of the miniature heating elements and the print head voltage. The maximum pulse width (TPU value) is compared to the pulse width calculated based on a conventional constant-joule (energy) algorithm and the lesser of the two values is used. In this way, the length of time the heating elements are turned on per burn cycle can be restricted in order to limit peak current demands. If the pulse width from the limit table is used, this will have the effect of lightening the dots used in that burn cycle. The dots will be lightened only to an extent required to not trip the electronic circuit breaker (56 in FIG. 3).

In accordance with the preferred embodiment of the invention, the values included in the pulse-width limit table are empirically derived from the hardware depicted in FIG. 3. First, an electronic load is connected to the hardware. A periodic load is applied equal to the frequency of the burn cycle used by the thermal recorder. The duty cycle of the load is set to 5% and the load is slowly increased until the electronic circuit breaker 56 is tripped. The value of the maximum current is then recorded. This sequence of steps is repeated with the duty cycle being increased by 5% until 100% is reached. Exemplary values derived by applying the foregoing procedure to a patient monitor incorporating the hardware of FIG. 3 are given in the table below. The data in the table column labeled "TPU Value" represent the values which the TPU 100 of the CPU 74 (see FIG. 4) would need to output to the print head 86 in order to achieve the corresponding duty cycle value shown in the table column labeled "Duty Cycle". (The TPU values are proportional to the duty cycles.)

| Duty Cycle (μs) | Peak Current (A) | TPU Value |
|---|---|---|
| 100 | 25.2 | 399.36 |
| 200 | 13.75 | 798.72 |
| 300 | 9.6 | 1198.08 |
| 400 | 7.4 | 1597.44 |
| 500 | 6.2 | 1996.8 |
| 600 | 5.1 | 2396.16 |
| 700 | 4.5 | 2795.52 |
| 800 | 4.2 | 3194.88 |
| 900 | 3.7 | 3594.24 |
| 1000 | 3.5 | 3993.6 |
| 1100 | 3.33 | 4392.96 |

-continued

| Duty Cycle (μs) | Peak Current (A) | TPU Value |
|---|---|---|
| 1200 | 3.1 | 4792.32 |
| 1300 | 2.9 | 5191.68 |
| 1400 | 2.8 | 5591.04 |
| 1500 | 2.7 | 5990.4 |
| 1600 | 2.65 | 6389.76 |
| 1700 | 2.55 | 6789.12 |
| 1800 | 2.49 | 7188.48 |
| 1900 | 2.49 | 7587.84 |
| 2000 | 2.49 | 7987.2 |

Figure 5:
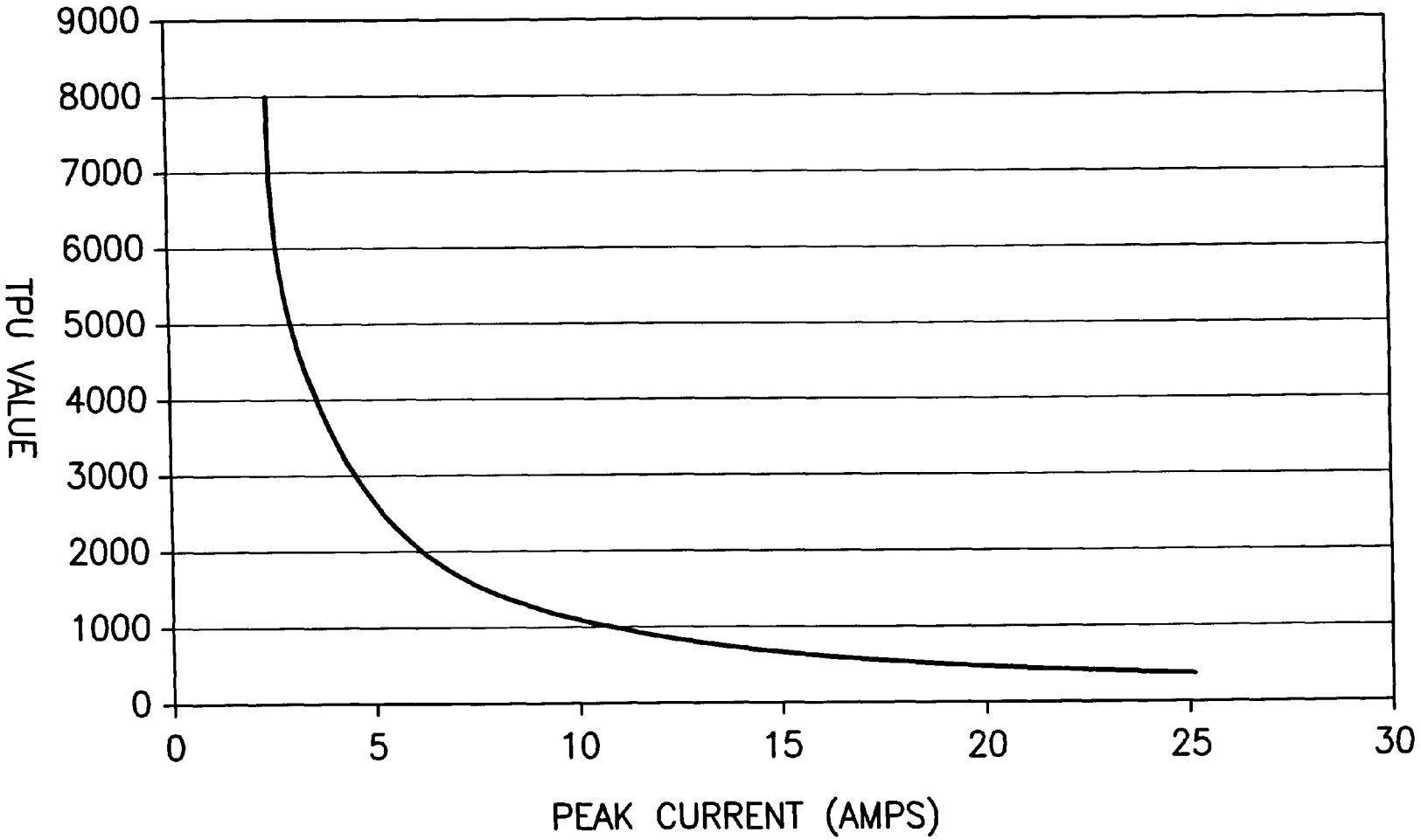
FIG. 5 is a graph of maximum current versus duty cycles values empirically derived from the hardware shown in FIG. 3.

In the next stage of the procedure, the maximum (peak) currents along with the respective TPU values are graphed in a spreadsheet as shown in FIG. 5. The spreadsheet is then used to calculate the equation which best fits the graphed data. For the data given in the above table, the best-fit equation was:

$$y=20880x^{-1.263}$$

This equation is then used to construct a pulse-width limit lookup table of current versus limit TPU values. That lookup table is stored in flash memory 76 (see FIG. 4A). Multiple pulse-width limit lookup tables, corresponding to different host supply voltages and current limits, can be pre-stored in boot/main code memory 76 and retrieved by the CPU.

While the invention has been described with reference to preferred embodiments, it will be understood by those skilled in the art that various changes may be made and equivalents may be substituted for elements thereof without departing from the scope of the invention. For example, it will be obvious to a person skilled in the art that a parameter which is a function of or dependent on current could be computed and used instead of current to acquire a limit pulse width. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A thermal recorder comprising a thermal print head having a multiplicity of elements for producing dots of heat in response to pulses and a central processing unit programmed to perform the following steps:

(a) calculating a value corresponding to a pulse width based at least in part on a voltage level being supplied to said thermal print head;

(b) determining the number of elements of said thermal print head to be activated, heating element resistance and print head voltage;

(c) calculating a total current which would be consumed by said elements to be activated with the determined heating element resistance and print head voltage;

(d) acquiring a limit pulse width value corresponding to said calculated total current; and (e) sending a pulse to each element to be activated, said pulse having a pulse width equal to the lesser of said calculated pulse width value and said limit pulse width value.

2. The thermal recorder as recited in claim 1, wherein said step of acquiring said limit pulse width value is performed by inputting said calculated amount of current into a lookup table.

3. A thermal recorder comprising:

a thermal print head having a multiplicity of elements for producing dots of heat in response to pulses;

means for calculating a value corresponding to a pulse width based at least in part on a voltage level being supplied to said thermal print head;

means for determining the number of elements of said thermal print head to be activated, heating element resistance and print head voltage;

means for calculating a total current which would be consumed by said elements to be activated with the determined heating element resistance and print head voltage;

means for providing a limit pulse width value corresponding to said calculated total current; and means for pulsing each element to be activated with a pulse having a pulse width equal to the lesser of said calculated pulse width value and said limit pulse width value.

4. The thermal recorder as recited in claim 3, wherein said means for providing a limit pulse width value comprises a lookup table of limit pulse width values.

5. A method of thermal recording, comprising the steps of:

(a) placing a substrate in opposition to a thermal print head having a multiplicity of elements for producing dots of heat;

(b) calculating a value corresponding to a pulse width based at least in part on a voltage level being supplied to said thermal print head;

(c) determining the number of thermal print head elements to be activated, heating element resistance and print head voltage;

(d) calculating a total current which would be consume d by said elements to be activated with the determined heating element resistance and print head voltage;

(e) determining a limit pulse width value corresponding to said calculated total current; and (f) sending a pulse to each element to be activated, said pulse having a pulse width equal to the lesser of said calculated pulse width value and said limit pulse width value.

6. A system comprising a data acquisition subsystem, a thermal print head having a multiplicity of elements, a processing subsystem coupled to receive acquired data from said data acquisition subsystem and send said acquired data to said thermal print head for printing, and a battery, said processing subsystem, said data acquisition subsystem and said thermal print head being powered by said battery in a battery power mode, wherein s aid processing subsystem is programmed to perform the following steps:

(a) calculating a value corresponding to a pulse width based at least in part on a voltage level being supplied to said thermal print head by said battery;

(b) determining the number of elements of said thermal print head to be activated, heating element resistance and print head voltage;

(c) calculating a total current which would be consumed by said elements to be activated with the determined heating element resistance and print head voltage;

(d) acquiring a limit pulse width value corresponding to said calculated total current; and (e) sending a pulse to each element to be activated, said pulse having a pulse width equal to the lesser of said calculated pulse width value and said limit pulse width value.

7. The system as recited in claim 6, wherein said step of acquiring said limit pulse width value is performed by inputting said calculated amount of current into a lookup table.

8. The system as recited in claim 6, wherein said processing system comprises a central processing unit which performs said steps (a) through (e).

9. The system as recited in claim 6, wherein said portable instrument is a patient monitor.

10. The system as recited in claim 6, further comprising an electronic circuit breaker through which passes current from said battery to said thermal print head, and a storage capacitor electrically coupled to a junction located between said electronic circuit breaker and said thermal print head.

11. The system as recited in claim 10, wherein said step of acquiring said limit pulse width value is performed by inputting said calculated amount of current into a lookup table containing values representing the maximum current at which said electronic circuit breaker will be tripped for each one of a multiplicity of values representing duty cycles of said thermal print head.

12. A system comprising a portable instrument and a thermal recorder coupled to said portable instrument, wherein said thermal recorder comprises a thermal print head having a multiplicity of elements for producing dots of heat in response to a pulse having a pulse width, and said portable instrument comprises a data acquisition subsystem, a processing subsystem coupled to receive acquired data from said data acquisition subsystem and send acquired data to said thermal recorder for printing, a battery for powering said processing subsystem, said data acquisition subsystem and said thermal print head in a battery power mode, and an electronic circuit breaker through which current passes from said battery to said thermal print head in said battery power mode, wherein said thermal recorder comprises a pulse-width limiting system which limits said pulse width to prevent tripping of said electronic circuit breaker.

13. The system as recited in claim 12, wherein said pulse-width limiting system comprises a central processing unit programmed to perform the following steps:

(a) calculating a value corresponding to a pulse width based at least in part on a voltage level being supplied to said thermal print head by said battery;

(b) determining the number of elements of said thermal print head to be activated, heating element resistance and print head voltage;

(c) calculating a total current which would be consumed if those elements were activated with the determined heating element resistance and print head voltage;

(d) acquiring a limit pulse width value corresponding to said calculated total current; and (e) sending a pulse to said elements to be activated, said pulse having a pulse width equal to the lesser of said calculated pulse width value and said limit pulse width value.

14. The system as recited in claim 13, wherein said step of acquiring said limit pulse width value is performed by inputting said calculated amount of current into a lookup table containing values representing the maximum current at which said electronic circuit breaker will be tripped for each one of a multiplicity of values representing duty cycles of said thermal print head.

15. The system as recited in claim 12, wherein said portable instrument further comprises a storage capacitor electrically coupled to a junction located between said electronic circuit breaker and said thermal print head.

16. The system as recited in claim 12, wherein said portable instrument is a patient monitor.

17. A system comprising a patient monitor and a thermal recorder coupled to said patient monitor, said patient monitor comprising an electronic circuit breaker and a battery, wherein said thermal recorder comprises a thermal print head having a multiplicity of elements for producing dots of heat in response to a pulse having a pulse width, said thermal print head being powered by said battery via said electronic circuit breaker in a battery power mode, wherein said thermal recorder comprises a pulse-width limiting system which limits said pulse width to prevent tripping of said electronic circuit breaker during powering of said thermal print head.

18. The system as recited in claim 17, wherein said pulse-width limiting system comprises a central processing unit programmed to perform the following steps:

(a) calculating a value corresponding to a pulse width based at least in part on a voltage level being supplied to said thermal print head by said battery;

(b) determining the number of elements of said thermal print head to be activated, heating element resistance and print head voltage;

(c) calculating a total current which would be consumed if those elements were activated with the determined heating element resistance and print head voltage;

(d) acquiring a limit pulse width value corresponding to said calculated total current; and (e) sending a pulse to said elements to be activated, said pulse having a pulse width equal to the lesser of said calculated pulse width value and said limit pulse width value.

19. The system as recited in claim 17, wherein said patient monitor further comprises a storage capacitor electrically coupled to a junction located between said electronic circuit breaker and said thermal print head.

20. A method for thermal recording of data acquired by a battery-powered patient monitor having an electronic circuit breaker, comprising the steps of:

(a) placing a substrate in opposition to a thermal print head having a multiplicity of elements for producing dots of heat;

(b) calculating a value corresponding to a pulse width based at least in part on a voltage level being supplied to said thermal print head by a battery;

(c) determining the number of thermal print head elements to be activated, heating element resistance and print head voltage;

(d) calculating a total current which would be consumed by said elements to be activated with the determined heating element resistance and print head voltage;

(e) determining a limit pulse width value corresponding to said calculated total current, said limit pulse width value being set so that the electronic circuit breaker will not trip when said calculated total current is consumed; and (f) sending a pulse to each element to be activated, said pulse having a pulse width equal to the lesser of said calculated pulse width value and said limit pulse width value.

* * * * *